US010053972B2

(12) United States Patent
Godfrey et al.

(10) Patent No.: US 10,053,972 B2
(45) Date of Patent: Aug. 21, 2018

(54) MONITORING OF STEAM CHAMBER GROWTH

(71) Applicants: SCHLUMBERGER TECHNOLOGY CORPORATION, Sugar Land, TX (US); STATOIL PETROLEUM AS, Stavanger (NO)

(72) Inventors: Robert John Godfrey, Bragg Creek (CA); Jonathan Paul Ingham, Weybridge (GB); David S. McCormick, Acton, MA (US); Hartmut Hubertus Schütt, Stavanger (NO); Mark Thompson, Trondheim (NO); Richard Tøndel, Trondheim (NO)

(73) Assignees: SCHLUMBERGER TECHNOLOGY CORPORATION, Sugar Land, TX (US); STATOIL PETROLEUM AS, Stavanger (NO)

( * ) Notice: Subject to any disclaimer, the term of this patent is extended or adjusted under 35 U.S.C. 154(b) by 811 days.

(21) Appl. No.: 14/405,512

(22) PCT Filed: Jun. 5, 2013

(86) PCT No.: PCT/US2013/044194

§ 371 (c)(1),
(2) Date: Dec. 4, 2014

(87) PCT Pub. No.: WO2014/191901

PCT Pub. Date: Dec. 27, 2013

(65) Prior Publication Data

US 2015/0114633 A1 Apr. 30, 2015

Related U.S. Application Data

(60) Provisional application No. 61/676,786, filed on Jul. 27, 2012, provisional application No. 61/662,269, filed on Jun. 20, 2012.

(51) Int. Cl.
*G01V 1/40* (2006.01)
*G01V 3/18* (2006.01)
(Continued)

(52) U.S. Cl.
CPC ..... *E21B 47/00* (2013.01); *E21B 43/2406* (2013.01)

(58) Field of Classification Search
CPC .... E21B 43/24; E21B 43/2401; E21B 47/065; E21B 47/00; E21B 43/2406
(Continued)

(56) References Cited

U.S. PATENT DOCUMENTS 4,958,684 A 9/1990 Nguyen et al.
5,214,384 A 5/1993 Sprunt et al.
(Continued)

OTHER PUBLICATIONS

Bacharach, R., M. Beller, C. C. Liu, J. Perdomo, D. Shelander, N. Dutta, and M. Benabentos. 2004, Combining rock physics analysis, full waveform prestack inversion, and high-resolution seismic interpretation to map lithology units in deep water: A Gulf of Mexico case study: The Leading Edge, 23, 376-383.
(Continued)

*Primary Examiner* — An Do

(57) ABSTRACT

A methodology and system promote hydrocarbon production from a reservoir using steam assisted gravity drainage. The technique comprises deploying sensors in a subsurface environment containing the reservoir. The sensors are used to obtain data on properties related to a steam assisted gravity drainage region of the reservoir. Based on the data collected from the sensors, the amount of steam injected into areas of the reservoir may be adjusted to facilitate, e.g., optimize, production of hydrocarbons.

20 Claims, 4 Drawing Sheets

(51) Int. Cl.
*E21B 47/00* (2012.01)
*E21B 43/24* (2006.01)

(58) Field of Classification Search
USPC ..... 702/2, 6, 13; 166/252.1, 272.3
See application file for complete search history.

(56) References Cited

U.S. PATENT DOCUMENTS

| | | | | |
|---|---|---|---|---|
| 6,502,456 | B1 | 1/2003 | Chen | |
| 7,100,689 | B2 | 9/2006 | Williams et al. | |
| 7,448,447 | B2 | 11/2008 | Walford | |
| 8,534,358 | B2 * | 9/2013 | Mauduit | E21B 43/24 166/252.1 |
| 2013/0277049 | A1 * | 10/2013 | Liu | E21B 43/2406 166/252.1 |

OTHER PUBLICATIONS

Kato, Ayato, Shigenobu Onozuka, Toru Nakayama, 2006, "Elastic Property Changes in a Bitumen Reservoid During Steam Injection", The Leading Edge, pp. 1124-1131.

Ma, X-Q. 2002, "Simultaneous Inversion of Pre-Stack Seismic Data for Rock Properties Using Simulated Annealing", Geophysics, 67, 1877-1865.

Morelli, G., and D. J. LaBrecque, 1996, Symposium on the Application of Geophysics to Engineering and Environmental Problems, 9, No. 1, 629-636.

Ziolkowski, Anton & Folke Englemark, 2009, "Use of Seismic and EM Data for Exploration, Appraisal and Reservoir Characterization", Presented at 2009 CSPG, CSEG, CWLS Convention. Calgary, Alberta, Canada.

International Search Report and Written Opinion of PCT Application Serial No. PCT/US2013/044194 dated Sep. 13, 2013 (10 pages).

* cited by examiner

MONITORING OF STEAM CHAMBER GROWTH

BACKGROUND

Steam assisted gravity drainage (SAGD) is a technique used to facilitate the production of hydrocarbons, such as heavy crude oil and bitumen. Horizontal wells are drilled into a reservoir containing the hydrocarbons and oriented so that one horizontal well is above the other. Steam is injected into the upper horizontal wellbore under high pressure to heat the hydrocarbons and to thus reduce the viscosity of the hydrocarbons. The heated hydrocarbons drain downwardly into the lower horizontal wellbore for production to a surface collection location.

SUMMARY

In general, the present disclosure provides a methodology and system for promoting hydrocarbon production from a reservoir using steam assisted gravity drainage. The technique comprises deploying sensors in a subsurface environment containing the reservoir. The sensors are used to obtain data on properties related to a steam assisted gravity drainage region of the reservoir. Based on the data collected from the sensors, the amount of steam injected into areas of the reservoir may be adjusted to facilitate, e.g. optimize, production of the hydrocarbon material.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate various implementations described herein and are not meant to limit the scope of various technologies described herein, and.

DETAILED DESCRIPTION

Figure 1:
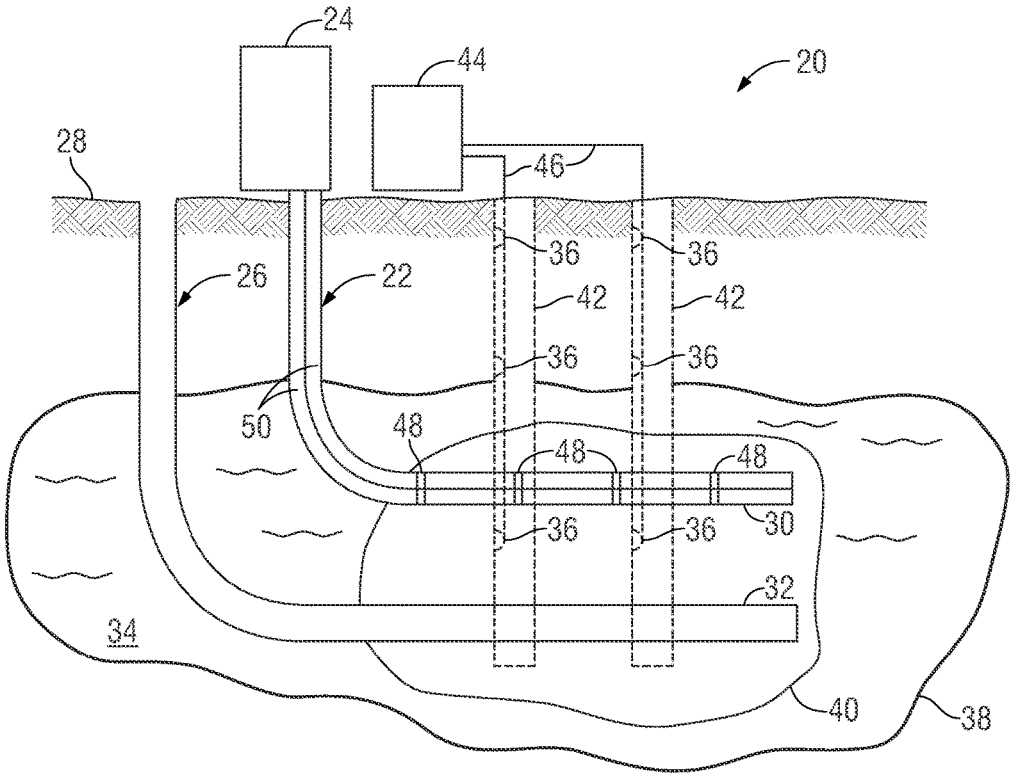
FIG. 1 is a schematic representation of a steam assisted gravity drainage technique employed in a reservoir, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology for facilitating production of hydrocarbons from a reservoir by steam assisted gravity drainage. According to an embodiment, sensors are deployed in a subsurface environment in a region in which steam assisted gravity drainage is employed to recover hydrocarbons, such as heavy oil and bitumen. The sensors obtain data on properties related to the steam assisted gravity drainage region. For example, the sensors may be designed to measure data used to determine electrical and elastic properties. The data is then processed to predict a distribution of the hydrocarbon-based material as well as the environmental conditions in the earth volume interrogated by the sensors. In some applications, the data is processed to map the spatial distribution of the steam chamber resulting from the steam assisted gravity drainage technique. By obtaining and measuring the data over time, the steam chamber growth may be tracked for evaluation and process optimization. Based on the data, the amount of steam injected into specific areas of the reservoir also may be adjusted to facilitate, e.g. optimize, production of the hydrocarbons from the reservoir.

In steam assisted gravity drainage production, knowledge regarding the spatial distribution (x,y,z) of the steam chamber is helpful in determining the volume of potentially movable hydrocarbons (net pay) the steam has contacted. Furthermore, monitoring the spatial evolution of the steam chamber over time (x,y,z,t) can guide the operator in optimizing production. For example, the operator can inject more steam into areas of the reservoir that have not been contacted and can reduce the amount of steam injected in areas where good contact has already been achieved.

By measuring data used to determine electrical and elastic properties of the subsurface using sensors, a greater understanding of the spatial distribution of the steam chamber may ultimately be gained. In an example, a plurality of sensors is permanently placed in a subsurface environment, e.g., within vertical boreholes. Data collected by the sensors over time can be geophysically inverted and the results of the inversion can be used to predict the subsurface spatial distribution of parameters such as resistivity, acoustic impedance, and shear impedance. These properties are related to and can be used to predict the distribution of, for example, in situ bitumen, swept bitumen (i.e., depleted reservoir), and transition zone. Performing such an analysis periodically or continuously enables tracking of the growth of the steam chamber. Furthermore, these parameters can be used to infer essential reservoir engineering parameters, such as hydrocarbon, water, and steam saturation, temperature, and viscosity, which are critical input parameters to reservoir simulation, prediction, and control models.

Referring generally to FIG. 1, a schematic representation is provided to illustrate a SAGD system and methodology according to an embodiment of the present disclosure. In this embodiment, steam assisted gravity drainage is employed to facilitate production of hydrocarbons, such as heavy oil and/or bitumen. Individual or plural wellbores may be utilized for steam injection and for production of hydrocarbons. Sensors are deployed in subsurface locations to obtain data related to the steam assisted gravity drainage region, and this data can be processed to predict spatial distribution of hydrocarbons, temperature distribution, and the associated steam chamber. The processed data also may be employed in controlling the injection of steam to specific areas of the reservoir within the steam assisted gravity drainage region.

In the embodiment of FIG. 1, a steam assisted gravity drainage system 20 is illustrated. The system 20 comprises at least one injection borehole 22 along which the injection of steam is controlled by a steam injection control system 24. Additionally, system 20 comprises at least one production borehole 26 through which hydrocarbons are produced to the surface 28. The injection borehole 22 and the production borehole 26 each have horizontal sections 30, 32, respectively, extending into a reservoir 34 containing the hydrocarbon materials, such as heavy oil and/or bitumen. Generally, the horizontal section 30 of the injection borehole 22 is disposed above the horizontal section 32 of the production borehole 26, as illustrated.

The steam assisted gravity drainage system 20 also comprises at least one sensor 36 and often a plurality of sensors 36 which are deployed subsurface in reservoir 34. For example, at least some of the sensors 36 are deployed in a steam assisted gravity drainage region 38 and may be used to collect data on properties related to the region 38. Processing of the data obtained by sensors 36 also enables detection of a steam chamber 40, and the collection and processing of this data over time enables tracking of the growth of steam chamber 40 and/or other changes to the steam chamber. By way of example, sensors 36 may be deployed in the subsurface environment along a borehole or a plurality of boreholes 42. In the example illustrated, the boreholes 42 are vertical boreholes which extend into the steam assisted gravity drainage region 38. However, the one or more boreholes 42 may be arranged in other orientations selected to place the sensors 36 at appropriate subsurface locations.

In the illustrated example, the sensors 36 are connected to a processing system 44 via wired or wireless communication lines 46. The sensors 36 are employed to obtain data on properties related to the steam assisted gravity drainage region 38 of reservoir 34. For example, the sensors 36 may be used to measure data that can be used to determine electrical and elastic properties of the steam assisted gravity drainage region 38. Additionally, the data from sensors 36 may be processed via processing system 44 to predict a spatial distribution of hydrocarbons, e.g., a spatial distribution of in situ bitumen, swept bitumen, and transition zone. The hot hydrocarbon, e.g., hot oil, in the region 38 is referred to as the transition zone, and the steam phase is referred to as the swept zone. Additionally, the data obtained by sensors 36 may be processed over time, e.g., periodically or continually, to image and track the growth of steam chamber 40 and/or other changes to the steam chamber 40.

Once the data is processed by processing system 44 to determine the spatial distribution of the hydrocarbons and/or the growth or other changes to steam chamber 40, steam injection control system 24 may be operated to change or adjust the amount of steam injected into selected areas of reservoir 34. Adjustment to steam injection at specific areas and specific locations within an injection well can be useful in facilitating production of the hydrocarbons, e.g., oil, by optimizing or otherwise enhancing production from the reservoir. Depending on the specifics of a given application and system, the adjustments to steam injected into specific areas of the reservoir may be achieved by a variety of techniques and/or devices. For example, the overall flow of steam and/or the pressure at which the steam is injected may be adjusted to increase or decrease the amount of steam to specific areas of the reservoir. Additionally, a variety of flow control devices 48, e.g., valves, may be deployed along the injection borehole 22 to enable control of the flow of steam to specific areas of the steam assisted gravity drainage region 38. Additionally, the steam may be directed along a plurality of flow paths 50 within a given injection borehole 22 or along a plurality of boreholes 22 so as to control increased or decreased injection of steam into specific areas of reservoir 34. In some applications, processing system 44 may also be used to control the steam injection.

Figure 2:
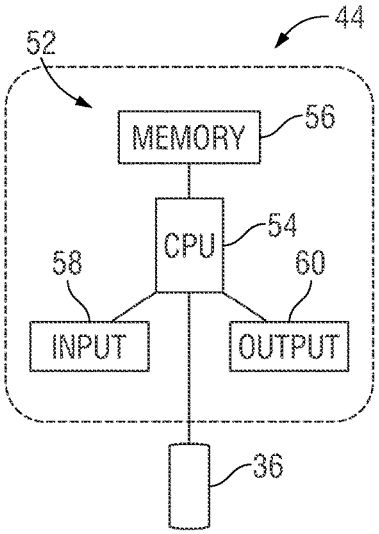
FIG. 2 is a schematic illustration of a processing system which may be used to process data in a manner which facilitates production of hydrocarbons from the reservoir via steam assisted gravity drainage, according to an embodiment of the disclosure.

Referring generally to FIG. 2, an example of processing system 44 is illustrated. In this particular example, the various data collected by sensors 36 may be output to and processed on processing system 44. Processing system 44 may be in the form of a computer-based processing system. In some embodiments, data is processed to construct models, update pre-existing models, and/or is subjected to modeling on the processing system 44. By way of example, the sensors may be of the type designed to measure data that can be used to determine electrical and elastic properties of the subsurface, and that data is inverted by processing system 44 to predict the subsurface spatial distribution of properties, such as resistivity, acoustic impedance, and shear impedance. These properties are related to, and can thus be used to predict, the distribution of hydrocarbons in reservoir 34, e.g., the distribution of in situ bitumen, swept bitumen, and transition zone. By way of example, processor-based system 44 may comprise an automated system 52 designed to automatically perform the desired data processing.

As discussed above, processing system 44 may be in the form of a computer-based system having a processor 54, such as a central processing unit (CPU). The processor 54 is operatively employed to intake and process data obtained from the sensor or sensors 36. The processor 54 also may be operatively coupled with a memory 56, an input device 58, and an output device 60. Input device 58 may comprise a variety of devices, such as a keyboard, mouse, voice recognition unit, touchscreen, other input devices, or combinations of such devices. Output device 60 may comprise a visual and/or audio output device, such as a computer display, monitor, or other display medium having a graphical user interface. Additionally, the processing may be done on a single device or multiple devices on location, away from the reservoir location, or with some devices located on location and other devices located remotely. Once the desired modeling, inversion techniques, and other programs are constructed based on the desired evaluation of the steam assisted gravity drainage region 38, the original data, processed data, and/or results obtained may be stored in memory 56.

Figure 3:
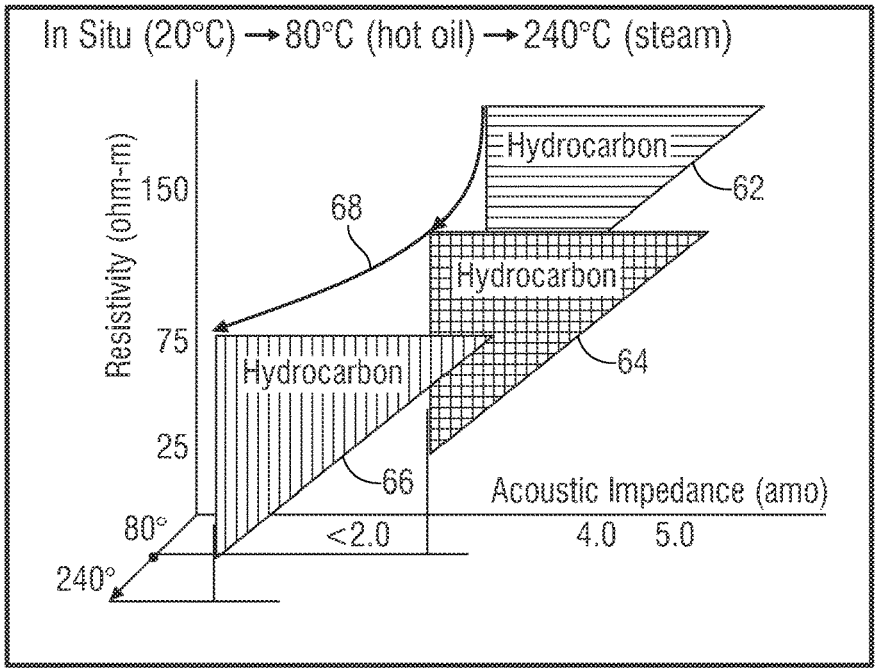
FIG. 3 is a graphical representation of a rock physics model describing the variation of resistivity and acoustic impedance with temperature, according to an embodiment of the disclosure.
Figure 4:
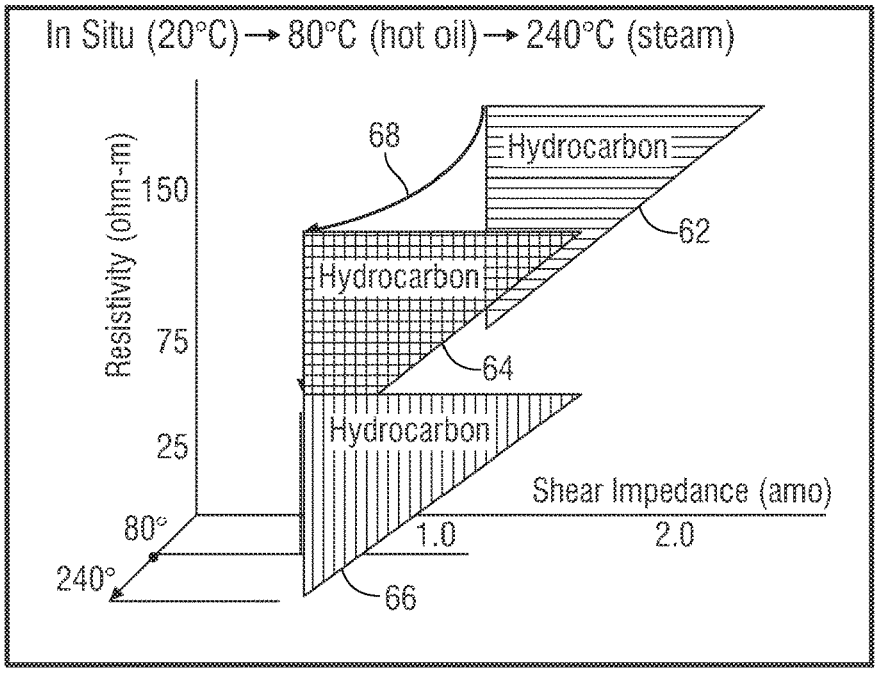
FIG. 4 is a graphical representation of a rock physics model describing the variation of resistivity and shear impedance with temperature, according to an embodiment of the disclosure.

Referring generally to FIGS. 3 and 4, an example of a rock physics model is illustrated. The rock physics model is for a given reservoir 34 and describes the variation of resistivity and acoustic impedance (FIG. 3)/shear impedance (FIG. 4) with temperature. The graphical representations of FIGS. 3 and 4 illustrate the variation in resistivity and acoustic impedance/shear impedance as the reservoir 34 is heated from in situ conditions (e.g., 20° C. represented by shaded area 62) through hot oil conditions (e.g., 80° C.

represented by shaded area 64) and further into a steam phase (e.g., 240° C. represented by shaded area 66). The hot oil phase 64 is referred to as the transition zone, and the steam phase 66 is referred to as the swept zone. In this particular example, the impedance axis is labeled in acoustic megaohm (amo) units (kg/second/$m^2$ $e^{06}$) and the resitivity axis is labelled in ohm-m in each of FIGS. 3 and 4. Of course, it must be noted that the conditions set forth above are those for one specific reservoir and will be different for other reservoirs.

Referring again to FIGS. 3 and 4, at in situ (20° C.) conditions, both the acoustic impedance and the resistivity exhibit their largest values and have a range of values as indicated by the horizontal and vertical extent of the triangular shaded region 62. As the reservoir 34 is heated, the steam assisted gravity drainage region 38 passes through a hot oil/water phase (80° C.) represented by triangular, shaded region 64. During this phase, the acoustic impedance is reduced slightly along with a more substantial reduction in resistivity. Further heating of the reservoir 34 causes a large reduction in both acoustic impedance and resistivity, as best illustrated in FIG. 3. The transition through the various phases is indicated by arrow 68.

A similar explanation applies for the shear impedance versus resistivity graph of FIG. 4. Heating the reservoir 34 from in situ conditions represented by shaded region 62 to the hot oil/water phase (80° C.) represented by triangular, shaded region 64 causes a substantial reduction in shear impedance and resistivity. Further heating results in a further decrease in resistivity, but very little change occurs with respect to shear impedance. As represented by arrow 68 pointing downwardly generally parallel to the resistivity axis, the transition from the hot oil/water phase 64 to the steam phase 66 creates minimal or no change in shear impedance. Thus, data related to resistivity, acoustic impedance, and shear impedance can be used to map the presence of both hydrocarbons and steam chamber 40.

Accordingly, the rock physics model describing the variation of resistivity and acoustic impedance/shear impedance with temperature can be used to gain knowledge of the steam assisted gravity drainage region 38 and to enhance, e.g., optimize, production of hydrocarbons. According to an embodiment, electrical and elastic measurements may be obtained from data gathered by sensors 36 disposed at a subsurface location, e.g., disposed in vertical boreholes 42. Although a variety of sensors 36 may be employed, an example is illustrated graphically in FIG. 5 in which sensors 36 comprise cold geophones 70, hot geophones 72, and electrodes 74. In this example, the hot geophones 72 are arranged to straddle the steam assisted gravity drainage region 38 of reservoir 34, e.g., a bitumen reservoir.

Figure 5:
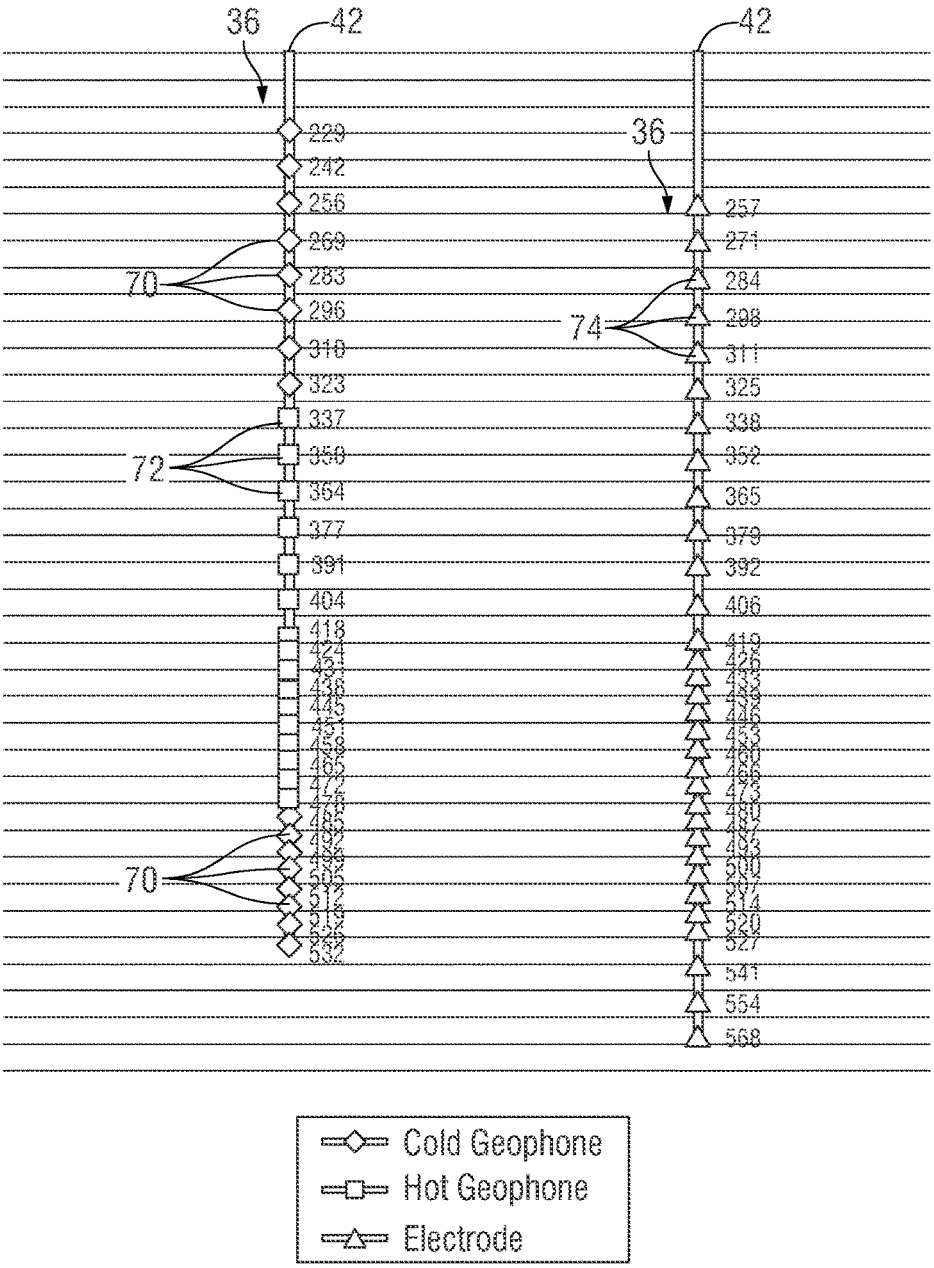
FIG. 5 is a diagram illustrating an example of an arrangement of numbered sensors deployed subsurface and used to collect data on properties of a steam assisted gravity drainage region, according to an embodiment of the disclosure.

By way of example, the sensors 36 may be cemented behind insulated casing within boreholes 42. However, different types and arrangements of sensors 36 may be employed. Additionally, different numbers of sensors 36, e.g., different numbers of cold geophones 70, hot geophones 72, and electrodes 74, may be employed for a given application. By way of example, the embodiment graphically represented in FIG. 5 utilizes 32 geophones and 32 electrodes in each borehole 42, e.g., in each vertical borehole 42. Each of the geophones and electrodes illustrated in FIG. 5 is associated with a number representative of the measured depth of each sensor (in meters) within the vertical borehole 42. The sensors 36, e.g., geophones and electrodes, are positioned and designed to measure data need to derive the desired parameters, e.g., electrical and elastic parameters, of the steam assisted gravity drainage region 38. The positioning of the sensors 36 is also based on prior geological and reservoir engineering models that predict the distribution of rock and fluid properties with time based on SAGD processes. The models are updated periodically based on the data collected by the sensors 36.

In this embodiment, the data collected by sensors 36 may be processed to predict a spatial distribution of hydrocarbons, e.g., a spatial distribution of in situ bitumen, swept bitumen, and transition zone. One methodology for processing the data collected by sensors 36 is to invert the electrical measurements to predict a subsurface spatial distribution of resistivity. For example, the electrical measurement data may be inverted into a cube of resistivity. Various inversion techniques are available and known to those of ordinary skill in the art. However, an example of a technique which may be used to invert electrical measurements into a cube of resistivity may be found in Morelli, G., and LaBrecque, D. J., 1996, *Symposium on the Application of Geophysics to Engineering and Environmental Problems,* 9, no. 1, pp. 629-638, incorporated herein by reference.

Similarly, the data collected by sensors 36 may be processed to predict a subsurface spatial distribution of acoustic (P wave) impedance and/or shear wavy impedance. For example, the elastic measurement data may be inverted into cubes of acoustic and shear impedance. Various inversion techniques are available and known to those of ordinary skill in the art, however an example of a technique which may be used to invert elastic measurements into cubes of acoustic and shear impedance may be found in Ma, X-Q, 2002, "Simultaneous Inversion of Pre-Stack Seismic Data for Rock Properties Using Simulated Annealing", *Geophysics,* 67, pp. 1877-1885, incorporated herein by reference.

The resulting resistivity, acoustic impedance, and shear impedance data can be partitioned into classes, e.g., three classes, related to the hydrocarbons in steam assisted gravity drainage region 38. By way of example, the three classes may comprise in situ bitumen, swept bitumen, and transition zone. In a specific embodiment, the resistivity, acoustic impedance, and shear impedance data may be transformed using Bayesian estimation theory. For example, the transformation may be accomplished by creating probability density functions (PDFs) of each class as a function of resistivity, acoustic impedance, and shear impedance. The probability density functions are then applied to the inversion results (i.e., the data transformed into cubes of resistivity, acoustic impedance, and shear impedance as discussed above) to produce class cubes and probability cubes for each class. The processing of data may be accomplished on processing system 44, and the results may be output to a suitable display or other output device 60. A description of a methodology that may be used in transforming the data via processing system 44 is described in Bachrach, R., Beller, M., Liu, C. C., Perdomo, J., Shelander, D., Dutta, N., and Benabentos, M., 2004, "Combining rock physics analysis, full waveform prestack inversion, and high-resolution seismic interpretation to map lithology units in deep water: A Gulf of Mexico case study": *The Leading Edge,* 23, pp. 378-383, incorporated herein by reference.

The data may be collected by sensors 36 continually or periodically over time. The data collected over time may be processed and transformed as discussed above to provide continual monitoring and description of the evolution of steam chamber 40 in reservoir 34. The monitoring of steam chamber 40 over time enables a variety of actions to be taken to enhance, e.g., optimize, production of hydrocarbon material from steam assisted gravity drainage region 38. For example, the amount of steam directed into specific areas of reservoir 34 may be adjusted based on the spatial distribution of the steam chamber 40. Additional steam may be injected into certain areas of the reservoir 34; and the injection of steam may be reduced with respect to other areas of reservoir 34 to facilitate removal of the hydrocarbons.

Figure 6:
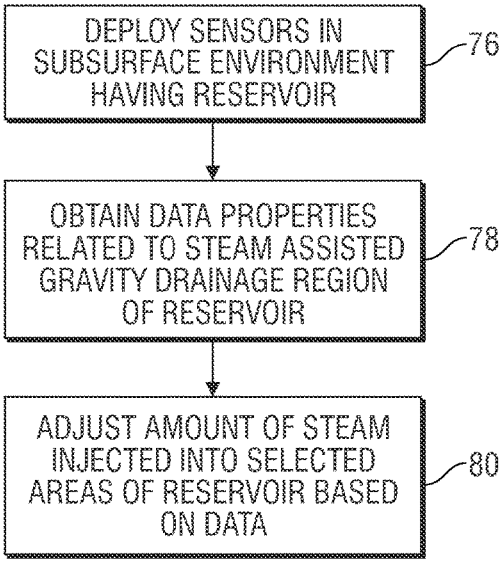
FIG. 6 is a flowchart illustrating an example of a methodology for facilitating production of hydrocarbons using steam assisted gravity drainage, according to an embodiment of the disclosure.

Referring generally to FIG. 6, an embodiment of a methodology for enhancing hydrocarbon production in steam assisted gravity drainage applications is illustrated. In this example, sensors 36, e.g., electrical and elastic sensors, are deployed in a subsurface environment having reservoir 34, as indicated by block 76. For example, the sensors 36 may be deployed along boreholes 42 formed in a vertical or other suitable orientation. Data is then obtained on properties related to the steam assisted gravity drainage region 38 of reservoir 34, as indicated by block 78. The data may comprise both raw data on electrical and elastic properties of the subsurface and processed data indicative of a spatial distribution of parameters, e.g., resistivity, acoustic impedance or shear impedance, related to the spatial distribution of hydrocarbons. Based on this data, the amount of steam injected into selected areas of reservoir 34 may be adjusted to enhance recovery of the hydrocarbons, as indicated by block 80.

Figure 7:
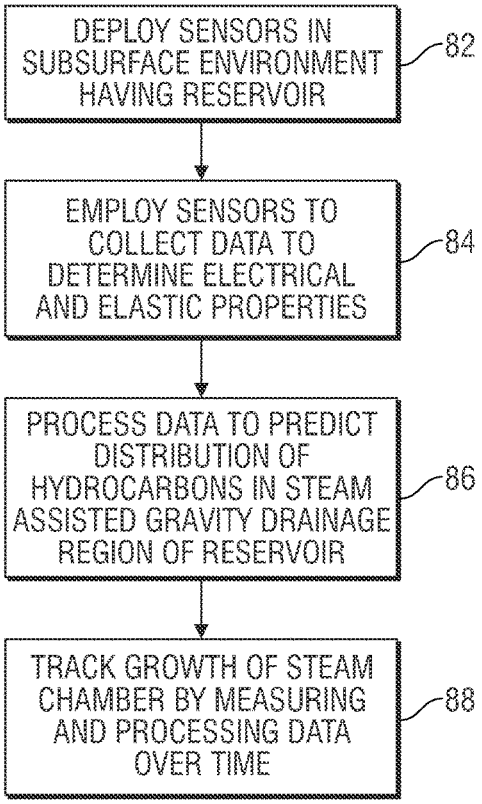
FIG. 7 is a flowchart illustrating another example of a methodology for facilitating production of hydrocarbons using steam assisted gravity drainage, according to an embodiment of the disclosure.

Another example of a methodology for enhancing, e.g., optimizing, production of hydrocarbons utilizing a steam assisted gravity drainage technique is illustrated in the flowchart of FIG. 7. In this example, sensors 36, e.g., electrical and elastic sensors, are similarly deployed in a subsurface environment having reservoir 34, as indicated by block 82. As discussed above, the sensors 36 may be deployed along boreholes 42 formed in a vertical or other suitable orientation. However, other techniques may be employed for positioning the sensors 36 at appropriate subsurface locations, e.g., techniques utilizing caverns, horizontal boreholes, natural spaces, and other subsurface features.

Once the sensors 36 are deployed, the sensors 36 are used to collect data to determine electrical properties, elastic properties, and/or other suitable properties, as indicated by block 84. For example, the sensors 36 may be in the form of geophones and electrodes designed to detect and measure data to determine electrical and elastic properties of the subsurface. The collected data is then processed according to appropriate models/algorithms to predict the distribution of hydrocarbons in steam assisted gravity drainage region 38 of reservoir 34, as indicated by block 86. As described above, the data may be processed to obtain a subsurface spatial distribution of properties such as resistivity, acoustic impedance, and/or shear impedance. These properties can then be used to project spatial distribution of the hydrocarbons, e.g., spatial distribution of in situ bitumen, swept bitumen, and transition zone. By measuring and processing the data from sensors 36 over time, e.g., continually or periodically, the growth of steam chamber 40 may be tracked, as indicated by block 88.

Tracking of the steam chamber 40 enables greater monitoring and control over the steam assisted gravity drainage technique of producing hydrocarbons. For example, the injection of steam may be altered to optimize or otherwise enhance hydrocarbon production. Depending on the growth of the steam chamber 40, additional steam may be injected into specific areas of the reservoir 34 or the amount of steam injected may be reduced in certain areas of reservoir 34. Steam pressures, steam flow rates, steam discharge regions, steam flow paths, and/or other steam-related parameters may be adjusted to control the application of steam to specific areas of reservoir 34 in a manner which enhances recovery of the hydrocarbons from the steam assisted gravity drainage region 38.

The specific arrangement of system components for a given steam assisted gravity drainage application may vary. For example, a variety of sensor types and sensor numbers may be deployed in many types of subsurface features. The steam injection system and the hydrocarbon production system may be adjusted according to the parameters of a given environment and application. Individual or multiple boreholes may be used to inject steam or to produce hydrocarbons. Additionally, each steam injection system may comprise a variety of control systems, flow control devices, flow paths, and other features for controlling the injection of steam. Additionally, various algorithms and models may be employed for inverting the data obtained by the sensors and/or processing the data in other ways to achieve indicators regarding the distribution of hydrocarbons. The processing system also may have a variety of forms and may be used separately to process data obtained from the sensors. In some applications, the processing system may be used to both process data and control the injection of steam based on accumulation and processing of data from the sensors.

Although only a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for monitoring steam chamber growth, comprising:

deploying sensors subsurface in a steam assisted gravity drainage region of a reservoir from which hydrocarbons are produced;

employing the sensors to measure data on the electrical and elastic properties of the steam assisted gravity drainage region;

processing the data received from the sensors at a computer processor located above the subsurface to predict a distribution of in situ bitumen, swept bitumen, and transition zone; and tracking growth of a steam chamber on one or more displays by measuring and processing the data over time to facilitate production of a hydrocarbon from the reservoir.

2. The method as recited in claim 1, wherein deploying the sensors comprises deploying the sensors in a vertical borehole.

3. The method as recited in claim 1, wherein deploying comprises deploying the sensors in a plurality of vertical boreholes.

4. The method as recited in claim 1, wherein processing the data comprises inverting the data to predict a subsurface spatial distribution of resistivity.

5. The method as recited in claim 1, wherein processing the data comprises inverting the data to predict a subsurface spatial distribution of acoustic impedance.

6. The method as recited in claim 1, wherein processing the data comprises inverting the data to predict a subsurface spatial distribution of shear impedance.

7. The method as recited in claim 1, wherein tracking the growth of the steam chamber comprises mapping the spatial distribution of the steam chamber over time.

8. The method as recited in claim 7, further comprising injecting additional steam into areas of the reservoir based on the spatial distribution of the steam chamber over time.

9. The method as recited in claim 7, further comprising injecting a reduced quantity of steam into areas of the reservoir based on the spatial distribution of the steam chamber over time.

10. A method of facilitating hydrocarbon production, comprising:

deploying sensors in a subsurface environment having a reservoir containing a hydrocarbon;

using the sensors to obtain data on properties related to a steam assisted gravity drainage region of the reservoir;

processing the data received from the sensors at a computer processor located above the subsurface environment to track growth of a steam chamber in the reservoir on one or more displays; and based on the data, changing an amount of steam injected into selected areas of the reservoir to facilitate production of the hydrocarbon.

11. The method as recited in claim 10, wherein using the sensors comprises using the sensors to measure data to derive electrical and elastic properties of the steam assisted gravity drainage region.

12. The method as recited in claim 10, further comprising using the data to track growth of a steam chamber.

13. The method as recited in claim 10, wherein deploying the sensors comprises deploying the sensors in a vertical borehole.

14. The method as recited in claim 10, further comprising processing the data to predict a distribution of in situ bitumen, swept bitumen, and transition zone.

15. The method as recited in claim 14, wherein processing the data comprises inverting the data to predict a subsurface spatial distribution of resistivity.

16. The method as recited in claim 14, wherein processing the data comprises inverting the data to predict a subsurface spatial distribution of acoustic impedance.

17. The method as recited in claim 14, wherein processing the data comprises inverting the data to predict a subsurface spatial distribution of shear impedance.

18. A system, comprising:

a plurality of sensors deployed subsurface in a steam assisted gravity drainage region of a reservoir from which a hydrocarbon is produced;

a computer processor located above the subsurface coupled to the plurality of sensors to process data from the plurality of sensors, the data being processed to track growth of a steam chamber in the reservoir; and based on the data, changing an amount of steam injected into selected areas of the reservoir to facilitate production of the hydrocarbon.

19. The system as recited in claim 18, wherein the computer processor is coupled to a display to enable output of data indicative of growth of the steam chamber.

20. The system as recited in claim 18, wherein the computer processor is employed to control injection of steam into selected areas of the reservoir.

* * * * *